US008899943B2

(12) United States Patent
Kobayashi et al.

(10) Patent No.: US 8,899,943 B2
(45) Date of Patent: Dec. 2, 2014

(54) DOUBLE-HEADED PISTON TYPE SWASH PLATE COMPRESSOR

(75) Inventors: Toshiyuki Kobayashi, Kariya (JP); Mitsuyo Ishikawa, Kariya (JP); Jun Kondo, Kariya (JP)

(73) Assignee: Kabushiki Kaisha Toyota Jidoshokki, Aichi-Ken (JP)

( * ) Notice: Subject to any disclaimer, the term of this patent is extended or adjusted under 35 U.S.C. 154(b) by 350 days.

(21) Appl. No.: 13/427,017

(22) Filed: Mar. 22, 2012

(65) Prior Publication Data

US 2012/0251344 A1 Oct. 4, 2012

(30) Foreign Application Priority Data

Mar. 31, 2011 (JP) ..... 2011-079842

(51) Int. Cl.
*F04B 27/10* (2006.01)
*F04B 27/08* (2006.01)
*F04B 27/12* (2006.01)

(52) U.S. Cl.
CPC ..... *F04B 27/0878* (2013.01); *F04B 27/1018* (2013.01); *F04B 27/1045* (2013.01); *F04B 27/12* (2013.01)
USPC ..... 417/269; 92/71

(58) Field of Classification Search
CPC .. F04B 27/08; F04B 27/1036; F04B 27/1045; F04B 27/109; F04B 27/10; F04B 27/1009; F04B 27/1018
USPC ..... 417/269; 92/71; 184/6.5; 91/502, 503
See application file for complete search history.

(56) References Cited

U.S. PATENT DOCUMENTS

| | | | | |
|---|---|---|---|---|
| 5,486,098 | A | 1/1996 | Kimura et al. | |
| 5,765,996 | A | 6/1998 | Fujii et al. | |
| 2003/0113211 | A1* | 6/2003 | Moroi et al. | 417/222.2 |
| 2003/0146053 | A1* | 8/2003 | Shintoku et al. | 184/6.16 |
| 2004/0184923 | A1* | 9/2004 | Iwanami et al. | 417/221 |
| 2008/0286125 | A1* | 11/2008 | Sugiura et al. | 417/269 |
| 2008/0298980 | A1 | 12/2008 | Lim et al. | |
| 2009/0238697 | A1 | 9/2009 | Sato et al. | |
| 2009/0297369 | A1* | 12/2009 | Mitsui et al. | 417/269 |

FOREIGN PATENT DOCUMENTS

| | | |
|---|---|---|
| CN | 101315070 | 12/2008 |
| JP | 6-249145 | 9/1994 |
| JP | 7-179839 | 10/1995 |
| JP | 7-279839 | 10/1995 |

(Continued)

OTHER PUBLICATIONS

Japan Office action, mail date is Feb. 5, 2013.

(Continued)

*Primary Examiner* — Charles Freay
*Assistant Examiner* — Philip Stimpert
(74) *Attorney, Agent, or Firm* — Greenblum & Bernstein, P.L.C.

(57) ABSTRACT

A double-headed piston type swash plate compressor is provided with a front housing including a suction chamber, a rear housing, a cylinder block, a rotation shaft, and double-headed pistons. The cylinder block includes cylinder bores, a rotation shaft accommodation bore, a communication conduit that communicates the suction chamber with the rotation shaft accommodation bore, and suction passages communicating the rotation shaft accommodation bore to front compression chambers. The rotation shaft includes a groove passage that communicates with the suction passages. Further, the rotation shaft includes an annular groove that communicates the communication conduit with the groove passage. The annular groove includes a front side surface, which is spaced toward the rear housing from an opening of the rotary shaft accommodation bore that faces the front housing.

7 Claims, 5 Drawing Sheets

(56) References Cited

FOREIGN PATENT DOCUMENTS

| | | |
|---|---|---|
| JP | 7-317658 | 12/1995 |
| JP | 2003-239856 | 8/2003 |
| JP | 2005-90447 | 4/2005 |
| JP | 2007-138925 | 6/2007 |
| JP | 2009-287465 | 12/2009 |

OTHER PUBLICATIONS

China Office action, dated May 6, 2014 along with an english translation thereof.

* cited by examiner

DOUBLE-HEADED PISTON TYPE SWASH PLATE COMPRESSOR

BACKGROUND OF THE INVENTION

The present invention relates to a double-headed piston type swash plate compressor.

Japanese Laid-Open Patent Publication No. 2009-287465 describes an example of a double-headed piston type swash plate compressor. The compressor of the publication is provided with a housing including a front cylinder block, a rear cylinder block, a front housing joined with the front cylinder block, and a rear housing joined with the rear cylinder block. A shaft bore (rotation shaft accommodation bore) extends through each cylinder block, and a rotation shaft is inserted through the shaft bores. A lip seal type shaft sealing device is arranged between the front housing and the rotation shaft. The front housing includes an accommodation chamber (suction chamber) that accommodates the shaft sealing device.

A swash plate chamber is defined in the front and rear cylinder blocks. A swash plate is arranged in the swash plate chamber. The swash plate is fixed to and rotated integrally with the rotation shaft. The front cylinder block includes a plurality of cylinder bores arranged around the rotation shaft. The rear cylinder block also includes a plurality of cylinder bores arranged around the rotation shaft. The cylinder bores of the front cylinder block are aligned with the corresponding cylinder bores of the rear cylinder block. A double-headed piston is accommodated in and reciprocated in each pair of aligned cylinder bores. The front cylinder block includes an intake hole that opens toward the swash plate chamber.

A communication passage extends through the front housing and front cylinder block between adjacent cylinder bores. The communication passage includes an inlet that opens in the swash plate chamber and an outlet that opens in the accommodation chamber. Thus, the communication passage communicates the swash plate chamber and the accommodation chamber.

A plurality of slots (communication conduits) are formed in the front cylinder block around the shaft bore near the front housing. The slots are formed at equal intervals in the circumferential direction. Each slot communicates the accommodation chamber and the shaft bore. Further, the rotation shaft includes a groove passage, which is formed to constantly overlap at least one of the slots. The slots constantly communicate the accommodation chamber and the groove passage. Further, the front cylinder block includes a plurality of suction passages that communicate each of the cylinder bores with the shaft bore. The suction passages are arranged at equal intervals in the circumferential direction. Each suction passage includes an inlet, which opens to the shaft bore in correspondence with the groove passage, and an outlet, which opens toward a front compression chamber defined in a corresponding one of the cylinder bores. Each suction passage is inclined so that the inlet is located at the rear of the outlet.

Refrigerant is drawn into the swash plate chamber through the intake hole. The refrigerant then flows through the communication chamber into the accommodation chamber. The refrigerant in the accommodation chamber flows through the slots into the groove passage. Then, the refrigerant is drawn from the groove passage into each front compression chamber through the corresponding suction passage.

In the piston type swash plate compressor of the above publication, the groove passage communicates the slots and the inlets of the suction passages. However, the overlapping region of the groove passage and the slots is often narrower than the overlapping region of the groove passage and the inlets of the suction passages. This may result in an insufficient amount of refrigerant being drawn into each suction passage through the slots and groove passage.

Accordingly, the above publication discloses a tapered communication conduit formed in the front cylinder block and extending in the circumferential direction entirely around the shaft bore near the front housing. The overlapping region of the tapered communication conduit and the groove passage is greater than the overlapping region of the groove passage and the slots. This resolves the problem of an insufficient amount of refrigerant being drawn into each suction passage through the groove passage. However, the formation of the tapered communication conduit in the cylinder block decreases the bearing surface of the cylinder block in the shaft bore that receives the rotation shaft near the front housing. As a result, the rotation shaft is apt to tilting. This may cause friction between the rotation shaft and the surface defining the shaft bore thereby adversely affecting wear resistance of the rotation shaft and shaft bore.

SUMMARY OF THE INVENTION

It is an object of the present invention to provide a double-headed piston type swash plate compressor that ensures wear resistance of a rotation shaft and rotation shaft accommodation bore while allowing for a sufficient amount of refrigerant to be drawn into a suction passage through a communication passage and a groove passage.

One aspect of the present invention is a double-headed piston type swash plate compressor provided with a front housing including a suction chamber, a rear housing, and a cylinder block arranged between the front housing and the rear housing. The cylinder block includes a plurality of cylinder bores, each defining a front compression chamber, a rotation shaft accommodation bore, a swash plate chamber, a communication conduit that communicates the suction chamber with the rotation shaft accommodation bore, and a plurality of suction passages, each communicating the rotation shaft accommodation bore with a corresponding one of the front compression chambers. A rotation shaft is supported in the rotation shaft accommodation bore in a rotatable manner and including a circumferential surface. The rotation shaft includes a groove passage formed in part of the circumferential surface, and rotation of the rotation shaft sequentially communicates the groove passage with the suction passages. A plurality of double-headed pistons are respectively arranged in the cylinder bores in a movable manner. Each of the double-headed pistons defines the front compression chamber at a front side of the corresponding cylinder bore. A swash plate is arranged in the swash plate chamber and fixed to the rotation shaft to rotate integrally with the rotation shaft. The swash plate reciprocates the double-headed pistons in the corresponding cylinder bores. The rotation shaft includes an annular groove that extends about the circumferential surface of the rotation shaft in a circumferential direction. The annular groove communicates the communication conduit with the groove passage. The annular groove includes a front side surface, which is spaced toward the rear housing in an axial direction of the rotation shaft from an opening of the rotary shaft accommodation bore that faces the front housing.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

One embodiment of the present invention will now be described with reference to FIGS. 1 to 5.

Figure 1:
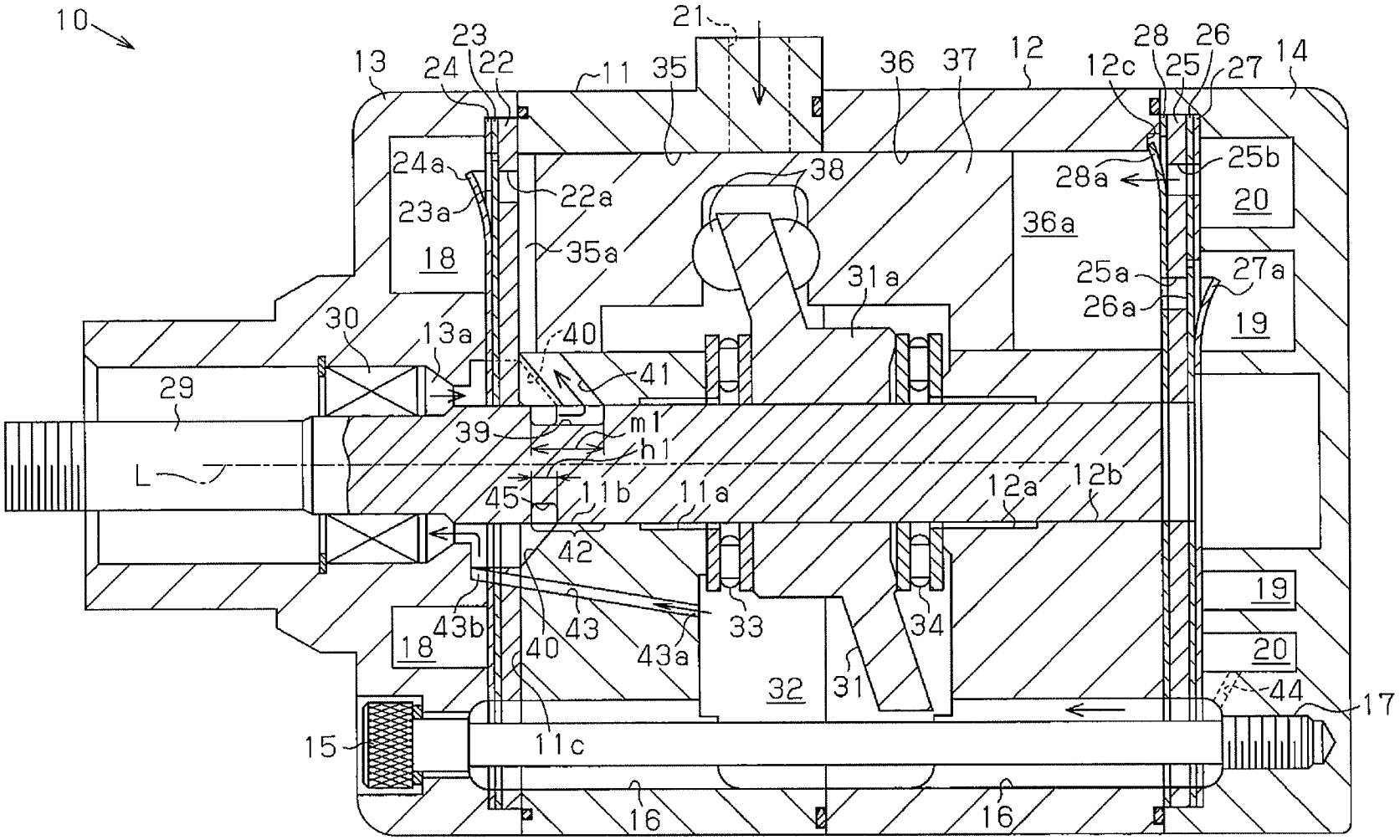
FIG. 1 is a cross-sectional view showing a double-headed piston type swash plate compressor according to one embodiment of the present invention.

Referring to FIG. 1, a double-headed piston type swash plate compressor 10 is provided with two cylinder blocks 11 and 12, which are joined with each other, a front housing 13, which is joined with the front (left as viewed in FIG. 1) cylinder block 11, and a rear housing 14, which is joined with the rear (right as viewed in FIG. 1) cylinder block 12.

A plurality of (five in the present embodiment) bolts 15 fasten the cylinder blocks 11 and 12, the front housing 13, and the rear housing 14 to one another. A plurality of bolt holes 16 extend through the cylinder blocks 11 and 12, the front housing 13, and the rear housing 14. The bolts 15 are inserted into bolt holes 16, and distal threaded portions 17 of the bolts 15 are fastened to the rear housing 14. The bolt holes 16 have a larger diameter than the bolts 15. Thus, a gap is formed between each bolt 15 and the wall defining the corresponding bolt hole 16.

The front housing 13 includes a discharge chamber 18. The rear housing 14 includes a discharge chamber 19 and a suction chamber 20. A valve plate 22, a discharge valve formation plate 23, and a retainer formation plate 24 are arranged between the front housing 13 and the cylinder block 11. The valve plate 22 includes discharge ports 22*a*, which are located at positions corresponding to the discharge chamber 18. Further, the discharge valve formation plate 23 includes discharge valves 23*a*, which are located at positions corresponding to the discharge ports 22*a*. The retainer formation plate 24 includes retainers 24*a*, which restrict the opening degree of the discharge valves 23*a*.

A valve plate 25, a discharge valve formation plate 26, a retainer formation plate 27, and a suction valve formation plate 28 are arranged between the rear housing 14 and the cylinder block 12. The valve plate 25 includes discharge ports 25*a*, which are located at positions corresponding to the discharge chamber 19, and suction ports 25*b*, which are located at positions corresponding to the suction chamber 20. Further, the discharge valve formation plate 26 includes discharge valves 26*a*, which are located at positions corresponding to the discharge ports 25*a*. The retainer formation plate 27 includes retainers 27*a*, which restrict the opening degree of the discharge valves 26*a*. The suction valve formation plate 28 includes suction valves (suction reed valves) 28*a* located at positions corresponding to the suction ports 25*b*. The rear cylinder block 12 includes notches 12*c*, which are formed in correspondence with the suction valves 28*a*. The notches 12*c* function as a retainer that restricts the opening degree of the suction valves 28*a*.

A rotation shaft 29 is arranged in the cylinder blocks 11 and 12. Shaft bores 11*a* and 12*a*, which serve as a rotation shaft accommodation bore, extends through the cylinder blocks 11 and 12, respectively. The rotation shaft 29 is inserted into the shaft bores 11*a* and 12*a* and rotatably supported by the cylinder blocks 11 and 12. The front housing 13 includes an insertion bore into which the rotation shaft 29 is inserted. A lip seal type shaft sealing device 30 is arranged between the rotation shaft 29 and the wall defining the insertion bore. An accommodation chamber 13*a* is defined between the insertion hole of the front housing 13 and the rotation shaft 29 to accommodate the shaft sealing device 30. In the present embodiment, the accommodation chamber 13*a* corresponds to a suction chamber arranged inside the front housing 13.

A swash plate 31 is fixed to the rotation shaft 29. The swash plate 31 rotates integrally with the rotation shaft 29 and is arranged in a swash plate chamber 32, which is defined in the cylinder blocks 11 and 12. A thrust bearing 33 is arranged between an end surface of the front cylinder block 11 around the shaft bore 11*a* and an annular basal portion 31*a* of the swash plate 31. A thrust bearing 34 is arranged between an end surface of the rear cylinder block 12 around the shaft bore 12*a* and the annular basal portion 31*a* of the swash plate 31. The thrust bearings 33 and 34 restrict axial movement, or movement along the axis L of the rotation shaft 29, at opposite sides of the basal portion 31*a* of the swash plate 31.

The front cylinder block 11 includes a plurality of (in the present embodiment, five) cylinder bores 35 (only one shown in FIG. 1) arranged around the rotation shaft 29. The rear cylinder block 12 includes a plurality of (in the present embodiment, five) cylinder bores 36 (only one shown in FIG. 1) arranged around the rotation shaft 29. The cylinder bores 35 of the front cylinder block 11 are aligned with the corresponding cylinder bores 36 of the rear cylinder block 12. A double-headed piston 37 is accommodated and reciprocated in each pair of aligned cylinder bores 35 and 36.

The rotation of the swash plate 31, which rotates integrally with the rotation shaft 29 is transmitted by a pair of shoes 38, which are arranged at opposite sides of the swash plate 31, to each double-headed piston 37. In cooperation with the rotation of the swash plate 31, the double-headed piston 37 reciprocates back and forth in the corresponding cylinder bores 35 and 36. The double-headed pistons 37 form five front compression chambers 35*a* and five rear compression chambers 36*a*, which total to ten cylinders, in the cylinder bores 35 and 36.

The cylinder blocks 11 and 12 include seal surfaces 11*b* and 12*b* defined by walls of the shaft bores 11*a* and 12*a*, into which the rotation shaft 29 is inserted. The seal surfaces 11*b* and 12*b* have a smaller diameter than other wall parts of the shaft bores 11*a* and 12*a*. The cylinder blocks 11 and 12 directly support the rotation shaft 29 with the seal surfaces 11*b* and 12*b*.

The front cylinder block 11 includes an intake hole 21, which extends through the peripheral wall of the cylinder block 11. The intake hole 21 opens toward the swash plate chamber 32 and is connected to an external refrigerant circuit (not shown) outside the double-headed piston type swash plate compressor 10.

Figure 2:
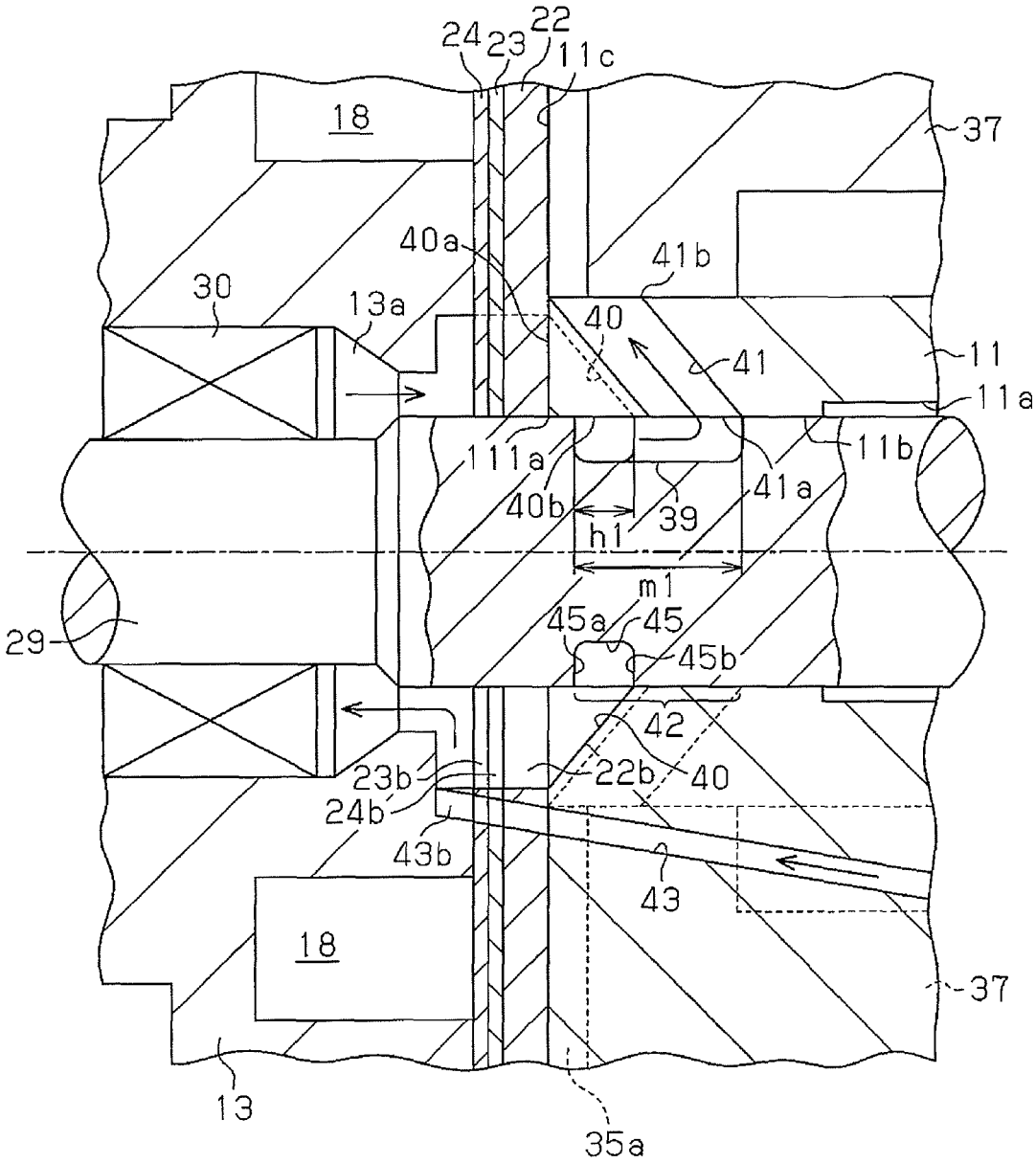
FIG. 2 is an enlarged cross-sectional view showing the periphery of a groove passage in FIG. 1.

Referring to FIGS. 1 and 2, a groove passage 39 is formed in part of the outer surface of the rotation shaft 29. In the outer surface of the rotation shaft 29, the groove passage 39 is formed at a location closer to the rear housing 14 than an open end 111*a* of the shaft bore 11*a* that faces the front housing 13.

Figure 3:
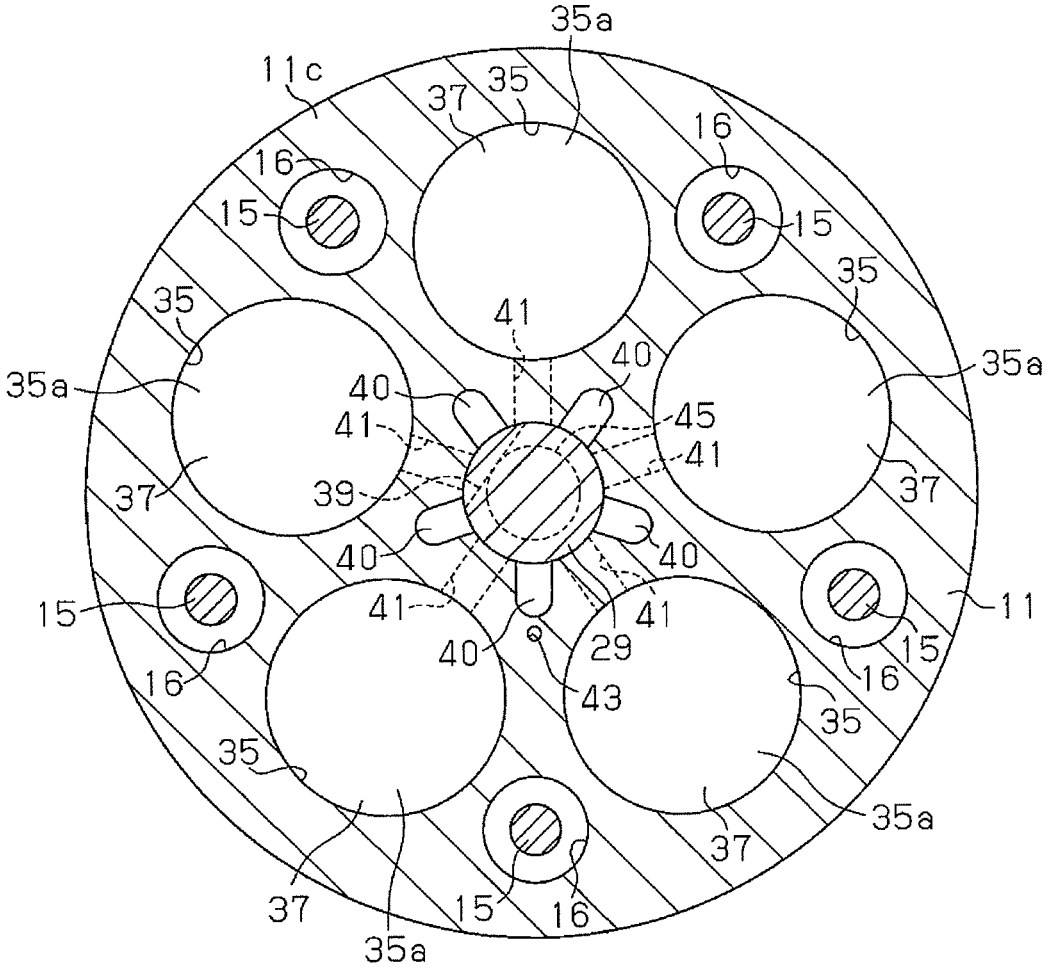
FIG. 3 is a schematic cross-sectional view showing the positional relationship of slots, an annular groove, the groove passage, and suction passages of FIG. 1.

A plurality of (five in the present embodiment) of slots 40 are arranged at the opening of the shaft bore 11*a* (the wall defining the shaft bore 11*a*) near the front housing 13 in the cylinder block 11. The slots 40 function as communication conduits that communicate the accommodation chamber 13*a* and the shaft bore 11*a*. As shown in FIG. 3, the slots 40 are arranged at equal intervals in the circumferential direction of the shaft bore 11*a*.

As shown in FIG. 2, the valve plate 22, the valve formation plate 23, and the retainer formation plate 24 respectively include holes 22*b*, 23*b*, and 24*b*. The holes 22*b*, 23*b*, and 24*b* are arranged at positions facing openings 40*a* of the slots 40 near the front housing 13. The holes 22*b*, 23*b*, and 24*b* constantly communicate the accommodation chamber 13*a* and the opening 40*a* of each slot 40 (shaft bore 11*a*). In this manner, the holes 22*b*, 23*b*, and 24*b* function as a communication conduit that communicates the accommodation chamber 13*a* and the shaft bore 11*a*.

Figure 4:
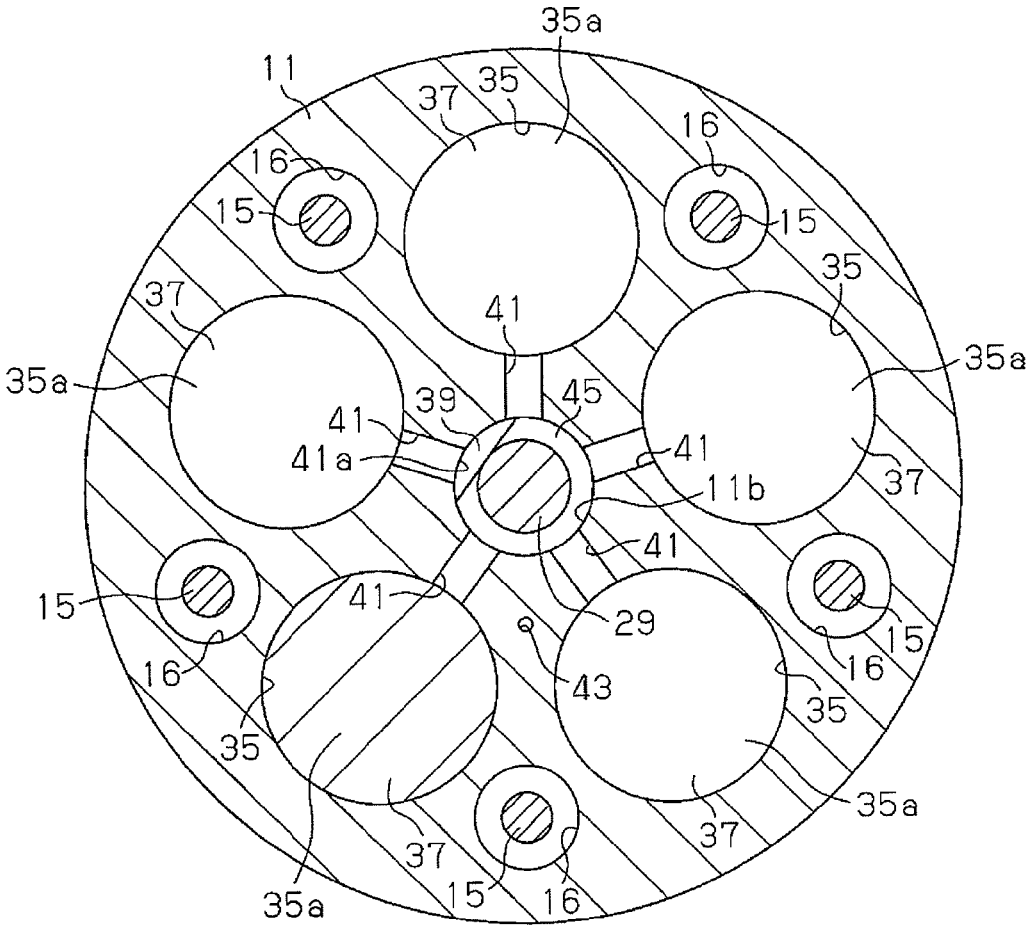
FIG. 4 is a schematic cross-sectional view showing the positional relationship of the annular groove, the groove passage, and the suction passages.

The front cylinder block 11 includes a plurality of suction passages 41, which communicate the cylinder bores 35 with the shaft bore 11*a*. Each suction passage 41 includes an inlet opening 41*a* and an outlet opening 41*b*. The inlet opening 41*a* is arranged in the seal surface 11*b* and opens at a location corresponding to the groove passage 39. The outlet opening 41*b* opens toward the front compression chamber 35*a* of the corresponding cylinder bore 35. The suction passage 41 is inclined so that the inlet opening 41*a* is located toward the rear from the outlet opening 41*b*. As shown in FIG. 4, the suction passages 41 are arranged at equal intervals in the circumferential direction. Rotation of the rotation shaft 29 intermittently communicates the openings 41*a* of the suction passages 41 with the groove passage 39.

As shown in FIG. 1, a communication passage 43 is arranged in the front housing 13 and the front cylinder block 11. The communication passage 43 extends through the valve plate 22, the valve formation plate 23, and the retainer formation plate 24. The communication passage 43 is located at the lower side of the cylinder block 11 and extends between two adjacent cylinder bores 35.

The communication passage 43 includes an inlet 43*a*, which opens in the swash plate chamber 32, and an outlet 43*b*, which opens in the accommodation chamber 13*a*. Thus, the communication passage 43 communicates the accommodation chamber 13*a* and the swash plate chamber 32. The rear housing 14 includes a communication passage 44, which communicates the suction chamber 20 and the bolt holes 16.

As shown in FIGS. 1 and 2, the rotation shaft 29 includes an annular groove 45 that extends throughout the entire circumferential surface of the rotation shaft 29. The annular groove 45 includes a side surface (front side surface) 45*a*, which is closer to the front housing 13, and a side surface (rear side surface) 45*b*, which is closer to the rear housing 14. The side surface 45*a* of the annular groove 45 is spaced toward the rear housing 14 by a predetermined amount from the open end 111*a* of the shaft bore 11*a* that faces the front housing 13. Further, the side surface 45*a* of the annular groove 45 is aligned with a side surface of the groove passage 39 that is located closer to the front housing 13. The side surface 45*b* of the annular groove 45 is aligned with the rear end of each slot 40 that is closer to the rear housing 14 in front of the inlet opening 41*a* of each suction passage 41. Thus, the annular groove 45 is not overlapped with the suction passages 41. Further, the annular groove 45 is in constant communication with the slots 40.

The portion of the rotation shaft 29 arranged in the front shaft bore 11*a* and surrounded by the seal surface 11*b* forms a rotary valve 42, which draws refrigerant into the front compression chambers 35*a* from the accommodation chamber 13*a* through the slots 40 and the annular groove 45.

Figure 5:
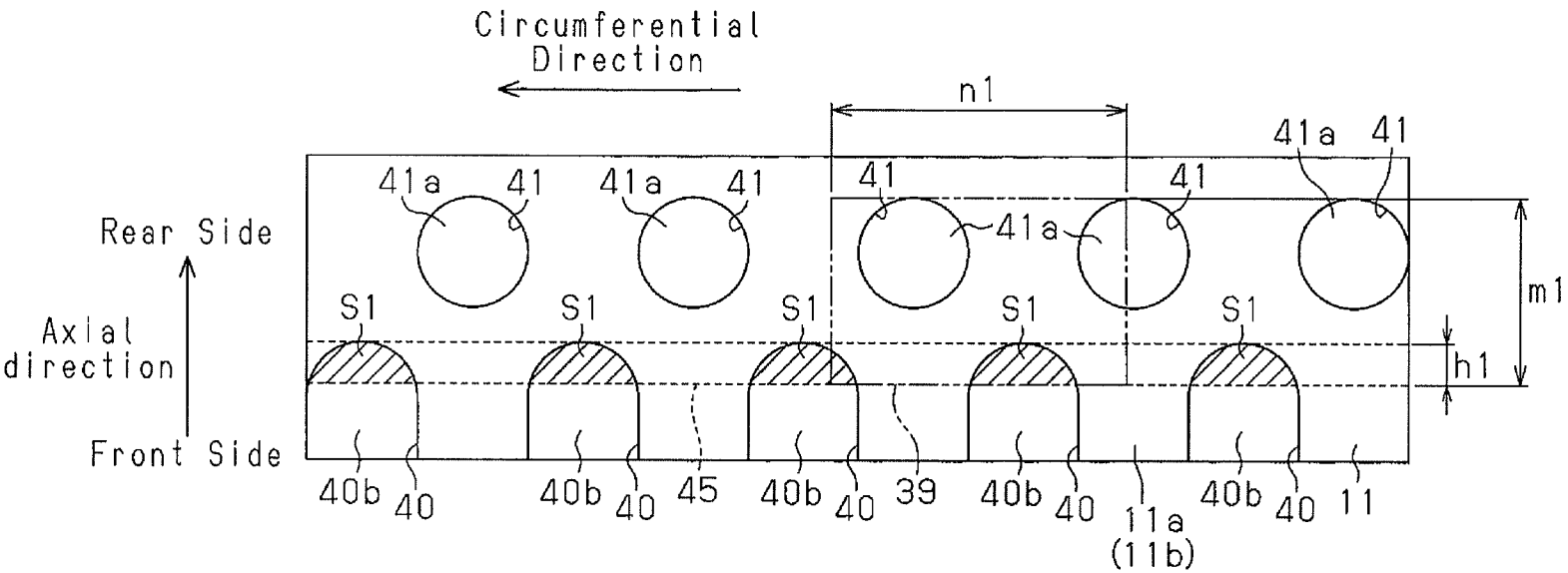
FIG. 5 is a deployment view showing the positional relationship of the slots, the suction passages, the annular groove, and the groove passage, which open in shaft bore of FIG. 1, in a circumferential direction and axial direction.

The positional relationship of the groove passage 39, the annular groove 45, the slots 40, and the suction passages 41 will now be described. In FIG. 5, the vertical direction corresponds to the axial direction, the upper side corresponds to the rear side, the lower side corresponds to the front side, and the lateral direction corresponds to the circumferential direction. Further, in FIG. 5, the double-dashed line indicates the opening of the groove passage 39, and the broken line indicates the location of the annular groove 45.

As shown in FIG. 5, the openings 41*a* of the suction passages 41 and openings 40*b* of the slots 40 are arranged at equal intervals in circumferential direction. The openings 41*a* of the suction passages 41 are shifted in the circumferential direction from the openings 40*b* of the slots 40 so that they are not aligned. More specifically, the openings 41*a* of the suction passages 41 are shifted by one-half of a pitch in the circumferential direction from the openings 40*b* of the slots 40.

The groove passage 39 has a length m1 in the axial direction. The length m1 is set to include the entire opening 41*a* of each suction passage 41, part of the opening 40*b* of each slot 40, and a groove width h1 of the annular groove 45 in the axial direction. The groove passage 39 has a length n1 in the circumferential direction that is set to constantly include the opening 41*a* of at least one suction passage 41. The rotation of the rotation shaft 29 sequentially overlaps the opening of the groove passage 39 with the entire opening 41*a* of each of the suction passages 41 and part of the opening 40*b* of each of the slots 40. Further, the opening of the groove passage 39 is constantly overlapped with the annular groove 45.

The opening of the annular groove 45 is overlapped with part of the opening 40*b* of each slot 40. Thus, the annular groove 45 is in constant communication with all of the slots 40. As the rotation shaft 29 rotates, refrigerant is constantly drawn from the accommodation chamber 13*a* to the groove passage 39 through the slots 40 and the annular groove 45.

When the groove passage 39 is in communication with the opening 41*a* of a suction passage 41 and refrigerant is drawn into the corresponding front compression chamber 35*a*, an opening area S1 in which the slots 40 are overlapped with the annular groove 45 (shown by hatching lines in FIG. 5) determines the amount of refrigerant drawn into the front compression chamber 35*a*. An increase in the opening area S1 increases the amount of refrigerant drawn into the front compression chamber 35*a*. An increase in the groove width h1 of the annular groove 45 in the axial direction increases the opening area S1.

The double-headed piston type swash plate compressor 10 employs a refrigerant suction structure for the rear compression chambers 36*a* that differs from that for the front compression chambers 35*a*. More specifically, the front compression chambers 35*a* employ a structure that draws refrigerant with the rotary valve 42, which is arranged between the accommodation chamber 13*a* and the front compression chambers 35*a*, and includes the groove passage 39, which sequentially communicates the slots 40 and the annular groove 45. In contrast, the rear compression chambers 36*a* employ the suction reed valves 28*a*, which are arranged between the suction chamber 20 and the corresponding rear compression chambers 36*a*. Each suction valve 28*a* opens and closes in accordance with the pressure difference between the suction chamber 20 and the corresponding rear compression chamber 36*a*.

The operation of the double-headed piston type swash plate compressor 10 will now be described.

In the double-headed piston type swash plate compressor 10, refrigerant is drawn from an external refrigerant circuit into the swash plate chamber 32 through the intake hole 21. Then, the refrigerant flows through the communication passage 43 and enters the accommodation chamber 13*a*.

The refrigerant flows from the accommodation chamber 13*a* through the holes 22*b*, 23*b*, and 24*b* of the valve plate 22, the valve formation plate 23, and the retainer formation plate 24 and enter the slots 40. Then, the refrigerant flows from the slots 40 through the annular groove 45 and enters the groove passage 39.

When a front cylinder bore 35 is performing an intake stroke, that is, when the corresponding double-headed piston 37 moves from left to right as viewed in FIG. 1, the groove passage 39 is in communication with the opening 41*a* of at least one suction passage 41. The rotary valve 42 acts to draw the refrigerant from the groove passage 39 through the suction passage 41, which is communication with the groove passage 39, and into the front compression chamber 35*a*. When the intake stroke ends, the groove passage 39 is completely moved away from the opening 41*a* of the suction passage 41. This stops drawing refrigerant into the front compression chamber 35*a* through the suction passage 41.

When the front cylinder bore 35 is performing the discharge stroke, that is, when the double-headed piston 37 moves from right to left as viewed in FIG. 1, the refrigerant drawn into the front compression chamber 35*a* is compressed to a predetermined pressure. The compressed refrigerant enters the corresponding discharge port 22*a*, forces open the discharge valve 23*a*, and is discharged into the discharge chamber 18. The refrigerant then flows from the discharge chamber 18 through a passage (not shown) and a discharge hole and enters the external refrigerant circuit.

In this manner, at the front side, the rotary valve 42 acts to sequentially communicate the groove passage 39 and the openings 41*a* of the suction passages 41 so that the intake, compression, and discharge strokes are performed on the refrigerant in the front compression chamber 35*a* of each of the five front cylinder bores 35.

When the rear cylinder bore 36 is performing an intake stroke, that is, when the corresponding double-headed piston 37 moves from right to left as viewed in FIG. 1, refrigerant is drawn from the suction chamber 20 through the corresponding suction port 25*b* and suction valve 28*a* and into the rear compression chamber 36*a*. More specifically, refrigerant is drawn from the external refrigerant circuit through the intake hole 21 and into the swash plate chamber 32. Then, the refrigerant flows through the bolt holes 16 and the communication passage 44 and enters the suction chamber 20. When a pressure difference is produced between the suction chamber 20 and the rear compression chamber 36*a*, the refrigerant enters the suction port 25*b*, forces to open the suction valve 28*a*, and enters the rear compression chamber 36*a*.

When the rear cylinder bore 36 is performing a discharge stroke, that is, when the double-headed piston 37 moves from left to right as viewed in FIG. 1, the refrigerant compressed in the rear compression chamber 36*a* enters the corresponding discharge port 25*a*, forces open the discharge valve 26*a*, and is discharged into the discharge chamber 19. The refrigerant then flows from the discharge chamber 19 through a passage (not shown) and a discharge hole and enters the external refrigerant circuit.

The above embodiment has the advantages described below.

(1) The rotation shaft 29 includes the annular groove 45, which constantly communicates the slots 40 with the groove passage 39 and extends throughout the entire circumferential surface of the rotation shaft 29. The annular groove 45 ensures a sufficient opening area S1, which determines the amount of refrigerant drawn into each front compression chamber 35*a*. This draws a sufficient amount of refrigerant into each suction passage 41 through the corresponding slot 40 and the groove passage 39. Further, the side surface 45*a* of the annular groove 45 that is closer to the front housing 13 is formed at a location that is closer to the rear housing 14 than the open end 111*a*, which faces the front housing 13, of the shaft bore 11*a*. This forms a bearing surface, which receives the rotation shaft 29, in the front cylinder block 11. The bearing surface extends from the open end 111*a* of the cylinder block 11 to a portion of the cylinder block 11 corresponding to the side surface 45*a* of the annular groove 45. The bearing surface also extends between adjacent slots 40. As a result, the rotation shaft 29 does not tilt. This minimizes friction between the rotation shaft 29 and shaft bore 11*a* and ensures the required wear resistance between the rotation shaft 29 and the shaft bore 11*a*.

(2) The side surface 45*b* of the annular groove 45 closer to the rear housing 14 is aligned with the ends, which are closer to the rear housing 14, of the slots 40. In other words, the annular groove 45 is not overlapped with the suction passages 41. This prevents the refrigerant from flowing from the annular groove 45 to every one of the suction passages 41.

(3) The side surface 45*b*, which is closer to the rear housing 14, of the annular groove 45 is aligned with the ends of the slots 40 that are closer to the rear housing 14. More specifically, the annular groove 45 forms the bearing surface for the rotation shaft 29 in the cylinder block 11 from the open end 111*a* to the portion of the cylinder block 11 corresponding to the side surface 45*a* of the annular groove 45. Further, the annular groove 45 maximizes the opening area S1. This ensures the required bearing surface for the rotation shaft 29 while increasing the amount of refrigerant drawn into the front compression chambers 35*a*.

It should be apparent to those skilled in the art that the present invention may be embodied in many other specific forms without departing from the spirit or scope of the invention. Particularly, it should be understood that the present invention may be embodied in the following forms.

In the above embodiment, the double-headed piston type swash plate compressor 10 includes five pairs of the cylinder bores 35 and 36. However, the present invention is not limited in such a manner. The number of pairs of the cylinder bores 35 and 36 may be two to four or six or more.

In the above embodiment, the number of the slots 40 is not particularly limited as long as the necessary amount of refrigerant can be drawn.

In the above embodiment, the slots 40 are used as communication conduits that communicate the accommodation chamber 13*a* and the shaft bore 11*a*. However, the present invention is not limited in such a manner. For example, a communication conduit may be formed to extend through the cylinder block 11 and connect the accommodation chamber 13*a* and shaft bore 11*a*. This further ensures that a bearing surface is obtained for the rotation shaft 29 near the opening of the shaft bore 11*a* facing the front housing 13.

In the above embodiment, refrigerant is drawn from the intake hole 21 through the swash plate chamber 32 and into the accommodation chamber 13*a* and the suction chamber. However, the present invention is not limited in such a manner. For example, passages extending from the intake hole 21 to the accommodation chamber 13*a* or the suction chamber 20 may be formed in the front housing 13 or the rear housing 14, and the refrigerant from the intake hole 21 may be drawn into the accommodation chamber 13*a* and the suction chamber 20 through these passages.

In the above embodiment, the suction valves 28*a* are used as a structure for drawing refrigerant into the rear compression chambers 36*a*. However, the present invention is not limited in such a manner, and a rotary valve may be used to draw refrigerant.

The present examples and embodiments are to be considered as illustrative and not restrictive, and the invention is not to be limited to the details given herein, but may be modified within the scope and equivalence of the appended claims.

The invention claimed is:

1. A double-headed piston type swash plate compressor comprising:

a front housing including a suction chamber;

a rear housing;

a cylinder block arranged between the front housing and the rear housing, wherein the cylinder block includes a plurality of cylinder bores, each defining a front compression chamber, a rotation shaft accommodation bore, a swash plate chamber, a communication conduit that communicates the suction chamber with the rotation shaft accommodation bore, and a plurality of suction passages, each communicating the rotation shaft accommodation bore with a corresponding one of the front compression chambers;

a rotation shaft supported in the rotation shaft accommodation bore in a rotatable manner and including a circumferential surface, wherein the rotation shaft includes a groove passage formed in part of the circumferential surface, and rotation of the rotation shaft sequentially communicates the groove passage with the suction passages;

a plurality of double-headed pistons respectively arranged in the cylinder bores in a movable manner, wherein each of the double-headed pistons defines the front compression chamber at a front side of the corresponding cylinder bore; and a swash plate arranged in the swash plate chamber and fixed to the rotation shaft to rotate integrally with the rotation shaft, wherein the swash plate reciprocates the double-headed pistons in the corresponding cylinder bores, wherein, the rotation shaft includes an annular groove that extends about the circumferential surface of the rotation shaft in a circumferential direction, and the annular groove communicates the communication conduit with the groove passage, and the annular groove includes a front side surface, which is spaced toward the rear housing in an axial direction of the rotation shaft from an open end of the rotary shaft accommodation bore that faces the front housing.

2. The compressor according to claim 1, wherein the front housing includes an insertion bore into which the rotation shaft is inserted, and the suction chamber is formed between the rotation shaft and a wall defining the insertion bore.

3. The compressor according to claim 1, wherein the communication conduit includes a plurality of slots arranged at intervals in the circumferential direction at the opening of the rotary shaft accommodation bore that faces the front housing.

4. The compressor according to claim 3, wherein a rear side surface of the annular groove is aligned with rear ends of the slots.

5. The compressor according to claim 1, wherein the number of the cylinder bores is five.

6. A double-headed piston type swash plate compressor comprising:

a front housing including an accommodation chamber for accommodating a shaft seal device;

a rear housing;

a cylinder block arranged between the front housing and the rear housing, wherein the cylinder block includes a plurality of cylinder bores, each defining a front compression chamber, a rotation shaft accommodation bore, a swash plate chamber, a communication conduit that communicates the accommodation chamber with the rotation shaft accommodation bore, and a plurality of suction passages, each communicating the rotation shaft accommodation bore with a corresponding one of the front compression chambers;

a rotation shaft supported in the rotation shaft accommodation bore in a rotatable manner and including a circumferential surface, wherein the rotation shaft includes a groove passage formed in part of the circumferential surface, and rotation of the rotation shaft sequentially communicates the groove passage with the suction passages;

a plurality of double-headed pistons respectively arranged in the cylinder bores in a movable manner, wherein each of the double-headed pistons defines the front compression chamber at a front side of the corresponding cylinder bore; and a swash plate arranged in the swash plate chamber and fixed to the rotation shaft to rotate integrally with the rotation shaft, wherein the swash plate reciprocates the double-headed pistons in the corresponding cylinder bores, wherein, the rotation shaft includes an annular groove that extends about the circumferential surface of the rotation shaft in a circumferential direction, and the annular groove communicates the communication conduit with the groove passage, and the annular groove includes a front side surface, which is spaced in a direction of the rear housing from an open end of the rotary shaft accommodation bore that faces the front housing.

7. A double-headed piston type swash plate compressor comprising:

a front housing including an accommodation chamber for accommodating a shaft seal device;

a rear housing;

a cylinder block arranged between the front housing and the rear housing, wherein the cylinder block includes a plurality of cylinder bores, each defining a front compression chamber, a rotation shaft accommodation bore, a swash plate chamber, a communication conduit that communicates the accommodation chamber with the rotation shaft accommodation bore, and a plurality of suction passages, each communicating the rotation shaft accommodation bore with a corresponding one of the front compression chambers;

a rotation shaft supported in the rotation shaft accommodation bore in a rotatable manner and including a circumferential surface, wherein the rotation shaft includes a groove passage formed in part of the circumferential surface, and rotation of the rotation shaft sequentially communicates the groove passage with the suction passages;

a plurality of double-headed pistons respectively arranged in the cylinder bores in a movable manner, wherein each of the double-headed pistons defines the front compression chamber at a front side of the corresponding cylinder bore; and a swash plate arranged in the swash plate chamber and fixed to the rotation shaft to rotate integrally with the rotation shaft, wherein the swash plate reciprocates the double-headed pistons in the corresponding cylinder bores, wherein, the rotation shaft includes an annular groove that extends about the circumferential surface of the rotation shaft in a circumferential direction, and the annular groove communicates the communication conduit with the groove passage, the annular groove includes a front side surface, which is spaced in a direction of the rear housing from an open end of the rotary shaft accommodation bore that faces the front housing, and a length of the groove passage in the axial direction of the shaft overlaps with a length of the annular groove in the axial direction of the rotation shaft.

* * * * *